US006309310B1

(12) United States Patent
Shira

(10) Patent No.: US 6,309,310 B1
(45) Date of Patent: Oct. 30, 2001

(54) WOOD-TYPE GOLF CLUB HEADS PROVIDED WITH VERTICAL GROOVES ON HITTING SURFACE

(75) Inventor: Chester S. Shira, San Diego, CA (US)

(73) Assignee: Carbite, Inc., San Diego, CA (US)

( * ) Notice: Subject to any disclaimer, the term of this patent is extended or adjusted under 35 U.S.C. 154(b) by 0 days.

(21) Appl. No.: 09/498,229

(22) Filed: Feb. 3, 2000

(51) Int. Cl.[7] ..... A63B 53/04
(52) U.S. Cl. ..... 473/331
(58) Field of Search ..... 473/330, 331, 473/324; D21/742–746, 751

(56) References Cited

U.S. PATENT DOCUMENTS

D. 193,098 6/1962 Davis, Jr. .
D. 303,699 9/1989 Chorne .
1,536,616 * 5/1925 Manning .
1,854,548 4/1932 Hunt .
2,005,401 6/1935 Storz .
4,065,133 * 12/1977 Gordos .
4,530,505 * 7/1985 Stuff .
5,354,059 * 10/1994 Stuff .
5,505,450 4/1996 Stuff .
5,785,610 7/1998 Birmingham .
6,048,277 * 4/2000 Raymond .

FOREIGN PATENT DOCUMENTS

25564 * of 1905 (GB) ..... 273/175

* cited by examiner

*Primary Examiner*—Sebastiano Passaniti
(74) *Attorney, Agent, or Firm*—John L. Gray; Shawnell Williams

(57) ABSTRACT

A wood-type golf club head is provided with vertical grooves adjacent at each end of the ball hitting surface in order to enhance the desired gear effect when balls are hit on the toe and heel of the club.

3 Claims, 1 Drawing Sheet

10
11
12
13

14
15
16
17
18
18

WOOD-TYPE GOLF CLUB HEADS PROVIDED WITH VERTICAL GROOVES ON HITTING SURFACE

BACKGROUND OF THE INVENTION

It is well known in the golf industry that balls hit from a driver or fairway wood should have a backspin rate adequate to create a stable flight pattern, but not so high as to cause excessive climbing of the ball to the point where roll and distance are sacrificed. An ideal trajectory can be created with a spin rate of approximately 1800 rpm. A spin rate of 3000 rpm, for example, will create a very high trajectory and a serious loss of distance. On the other hand, a very low spin rate, for example under 500 rpm, creates an unstable flight and very short total shot distances.

Current methods of creating the desired trajectory include 1) raising or lowering the center of gravity of the club head; 2) creating a low friction face, even to the extent of the elimination of grooves; and 3) reducing the loft of the club face. It has been proven that the first and third techniques work for professional and very low handicap amateurs but not well for the average mid to high handicap golfer. Method 2 gworks for the average player when golfing conditions are perfect but when the ball or club face are wet, thus producing low friction, mis-hits on the toe or heel of the club result in wild and unpredictable shots due to loss of the desired and well known gear effect. Spin rates in the center of the low friction faces are still under control in wet weather even through the spin rate is reduced.

BRIEF SUMMARY OF THE INVENTION

The problem set forth above can be eliminated by providing vertical grooves on the face of the golf club head. If the entire face of the golf club head is provided with vertical grooves, these grooves will not influence ball spin and flight in the center of the club head but will create the necessary friction and side spin to enhance the desired gear effect when balls are hit on the toe and heel of the club. Alternatively, it is possible to have horizontal grooves in the center of the club face and vertical grooves on both ends of the club face and thus, obtain the same desired result.

It is therefore an object of this invention to provide a golf club head having a ball striking surface and providing vertical grooves thereon which will create the necessary friction and side spin to enhance the desired gear effect when balls are hit on the toe and the heel of the club.

This, together with other objects of the invention, will become apparent from the following detailed description of the invention and the accompanying drawings.

DETAILED DESCRIPTION OF THE INVENTION

Figure 1:
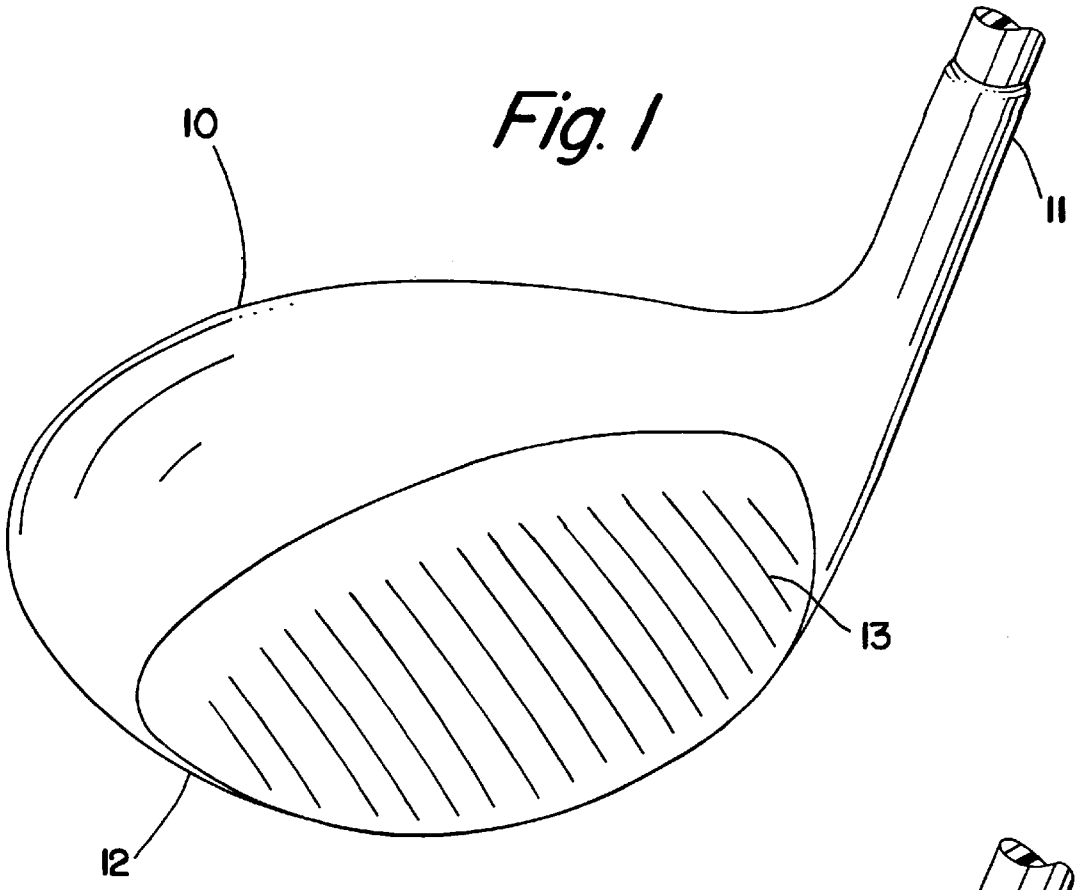
FIG. 1 is a perspective view of a golf club head showing the ball striking surface provided with vertical grooves thereon.

Referring now to FIG. 1, there is shown a typical wood-type golf club head 10 provided with a hosel 11, upper and lower surfaces, and a ball striking surface 12. The ball striking surface 12 is provided with a toe portion and heel portion and is further provided with a plurality of vertical grooves thereon.

Figure 2:
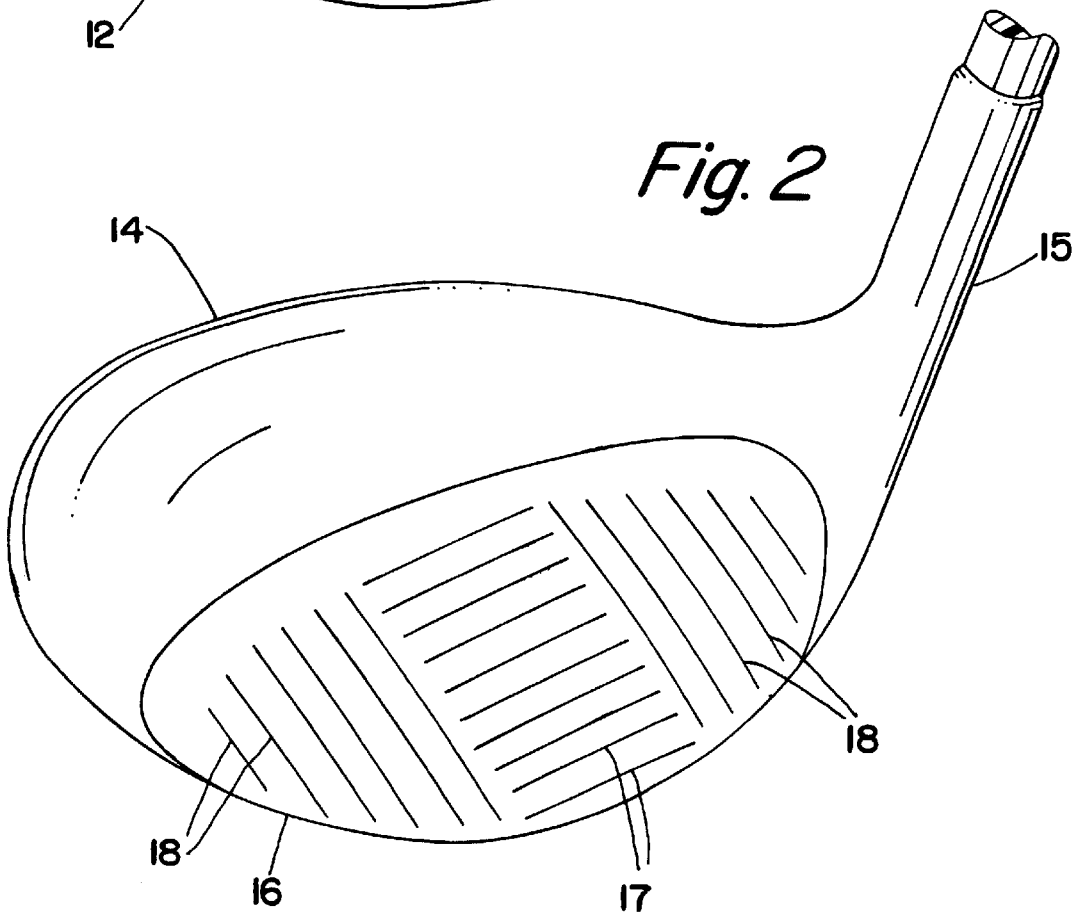
FIG. 2 is a perspective view of a golf club head showing the ball striking surface with horizontal grooves in the middle thereof and vertical grooves on each side.

Referring now to FIG. 2, there is shown a wood-type golf club head 14 provided with a customary hosel 15 and a ball striking surface 16 which is provided with horizontal grooves 17 in the center of the ball striking surface 26 with vertical grooves 18—18 being provided on each side thereof.

In using golf club heads provided with vertical grooves as shown in FIGS. 1 and 2, notable improvements in the accuracy of ball flight when balls are hit on the heel or toe of the ball striking surface of the golf club head are achieved.

EXAMPLE

Two identical wood-type drivers were assembled for testing. Driver No. 1 was provided with a normal smooth hitting surface except for horizontal grooves. Driver No. 2 had vertical grooves rather than horizontal grooves. A golf robot using a swing speed of 90 mph was used for the following tests. When the club faces and test balls were dry and balls were hit in the center of the club face, both drivers performed approximately the same. When balls were struck on the toe and the heel, driver No. 1 produced a scatter of 60 feet and driver No. 2 produced a scatter of only 8 feet. When the club faces were lubricated simulating wet conditions on the golf course, both club heads performed similarly on center hits. However, when balls were struck on the heel and toe, driver No. 1 produced a scatter of over 120 feet and driver No. 2 produced a scatter of only 28 feet, thus, demonstrating the effectiveness of vertical grooves on the heel and toe of golf clubs.

The center of gravity of the club head of this invention is located to assure the correct trajectory and the face angle is selected to create the desired launch of the ball. The material and surface of the face will be selected to provide the desired coefficient of friction necessary for the desired spin rates.

While this invention has been shown and described with respect to a detailed embodiment thereof, it will be understood by those skilled in the art that various changes in form and detail thereof may be made without departing from the scope of the claims of the invention.

What is claimed is:

1. A golf club head comprising a wood type club head body provided with a ball hitting surface having a toe portion and a heel portion, an upper surface, and a lower surface; said ball hitting surface having spaced vertical grooves covering at least the toe and the heel portions; said spaced vertical grooves extending substantially from adjacent said lower surface to adjacent said upper surface, whereby the spaced vertical grooves provide friction for imparting side spin to a ball struck on the heel or toe portions to enhance the gear effect of the club body when said heel or toe portions are subjected to wet weather conditions.

2. The golf club head of claim 1 wherein said entire ball hitting surface is provided with spaced vertical grooves thereon.

3. The golf club head of claim 1 wherein said ball hitting surface is provided with spaced horizontal grooves thereon in the center of said ball hitting surface and also is provided with spaced vertical grooves thereon at either side of and immediately adjacent said spaced horizontal grooves on said ball hitting surface.

* * * * *